US005944920A

United States Patent [19]

Fukushima

[11] Patent Number: 5,944,920

[45] Date of Patent: Aug. 31, 1999

[54] PISTON RING MATERIAL EXCELLENT IN WORKABILITY

[75] Inventor: Katsuaki Fukushima, Shimane-ken, Japan

[73] Assignee: Hitachi Metals, Ltd., Tokyo, Japan

[21] Appl. No.: 08/949,824

[22] Filed: Oct. 14, 1997

Related U.S. Application Data

[63] Continuation of application No. 08/630,588, Apr. 10, 1996, abandoned.

[51] Int. Cl.[6] ..... C22C 38/18

[52] U.S. Cl. ..... 148/325; 420/34; 420/67; 420/104; 420/105; 420/110; 420/111; 148/333; 148/334

[58] Field of Search ..... 420/34, 67, 100, 420/101, 104, 105, 110, 111; 148/325, 333, 334

[56] References Cited

U.S. PATENT DOCUMENTS

| | | | |
|---|---|---|---|
| 3,859,147 | 1/1975 | Philip | 420/69 |
| 5,439,751 | 8/1995 | Fesler | 428/614 |

FOREIGN PATENT DOCUMENTS

| | | |
|---|---|---|
| 3633490 | 4/1987 | Germany . |
| 48-020683 | 6/1973 | Japan . |
| 59-159973 | 9/1984 | Japan . |
| 60-110844 | 6/1985 | Japan . |
| 61-213348 | 9/1986 | Japan . |
| 1/142057 | 6/1987 | Japan . |
| 2/310343 | 12/1990 | Japan . |
| 4/028847 | 1/1992 | Japan . |
| 5-186854 | 7/1993 | Japan . |
| 60-17196 | 1/1994 | Japan . |
| 6-126793 | 5/1994 | Japan . |
| 6-145911 | 5/1994 | Japan . |
| 6/145912 | 5/1994 | Japan . |
| 6-172943 | 6/1994 | Japan . |
| 6/221436 | 8/1994 | Japan . |
| 6-246338 | 9/1994 | Japan . |
| 267752 | 7/1950 | Switzerland . |

*Primary Examiner*—Sikyin Ip
*Attorney, Agent, or Firm*—Finnegan, Henderson, Farabow, Garrett & Dunner

[57] ABSTRACT

Disclosed is a piston ring material excellent in workability, which consists essentially of, by weight, 0.4 to 1.0% of C, 5.0 to 25.0% of Cr, at least one of not more than 0.25% Si and not more than 0.30% Mn, and balance of Fe and impurities. The material may optionally contain one or more elements of Mo, W, V and Nb in place of a part of Fe.

8 Claims, 1 Drawing Sheet

PISTON RING MATERIAL EXCELLENT IN WORKABILITY

This application is a continuation of application Ser. No. 08/630,588, filed Apr. 10, 1996, now abandoned.

FIELD OF THE INVENTION

This invention relates to piston ring materials suitable for use in internal-combustion engines.

BACKGROUND OF THE INVENTION

Internal-combustion engines have recently been improved in many respects so as to cope with the growing demands for saved fuel oil, sophisticated engine performance, reduced body weight, lessened exhaust gas and the like. In particular, a piston ring adapted for expansibly slidable movement inside the cylinder of such an internal-combustion engine has been required to provide reduced thickness in attaining weight lightness and to offer improved fatigue resistance, wear resistance, scuffing resistance and like properties in ensuring high-speed rotation. To meet these physical requirements, a piston ring made of steel is taking the place of a conventional counterpart made of cast iron because the former is rather easy to reduce its weight, great in mechanical strength and highly resistant to fatigue.

As regards the above-stated, steel piston ring, its top ring (pressure ring) in common use is based on a Si-Cr steel or a martensitic stainless steel having 11 to 17% Cr and resulting from chromium plating or nitriding treatment. A second ring of that piston ring is at present dominantly of cast iron which, however, is being replaced with steel in response to the physical qualities desired above. The cast iron-made second ring itself is subjected to chromium plating or nitriding treatment prior to being practically used.

Oil rings, which are so assembled as to scrape a fuel oil during sliding-contact with the cylinder, are generally classified into two different types, i.e. three-piece and two-piece types. The three-piece type of oil ring has two side rails held in directly slidable relation to the cylinder and formed mainly from such a material as is composed with a wear resistance property taken as particularly important. This material is made rich in Cr content (17 Cr) and subjected to nitriding treatment. The two-piece oil ring is structured with a shaped-section wire material having a not simple sectional figure.

In the production of the foregoing piston rings, several different materials are employed according to the constitutive portions which depend on the structural types of internal-combustion engines to be designed and on the physical properties to be achieved. Namely, in the case where piston rings are mass-produced, their slidably movable portions are formed from a 0.8–0.9 C-17 Cr steel which may if appropriate contain Mo and V. This is due to high resistances to wear, scuffing and corrosion called for as important qualities. For top rings generally for use in gasoline engines, 0.7 C–12 Cr steel and the like are used in which Mo and V may optionally be incorporated.

As prior publications relating to the piston ring technology, JP-B2-57-8302 is cited to disclose a pressure ring for use as a piston ring, JP-B2-58-4654 to disclose a steel material for formation of a piston ring and JP-B2-2-4829 to disclose a side rail for an oil ring.

In producing the steel piston ring, a flat wire material or a shaped-section wire material is heated at from 900 to 1,100° C. and thereafter annealed with quenching, followed by tempering of the thus treated material at rather high a temperature, so that the resulting material is adjusted in its hardness after heat treatment to a somewhat low level of about 38 to 52 HRC. Such a smaller hardness is intended to gain good bending working at a subsequent process step of shaping that material into a piston ring. To be more specific, a greater hardness is preferred when the desired qualities of the piston ring product, such as wear resistance, scuffing resistance and the like, are taken as primary. In this instance, however, the starting material causes objectionable breakage in the course of bending working. Common practice resides in holding the hardness after heat treatment at a low level even with a slight sacrifice to the desired qualities of the ultimate piston ring. After being heated-treated with continuous bending working, the flat wire or shaped-section wire material is severed to individual rings that are subsequently subjected to thermal correction and to surface treatment (as by plating or nitriding), whereby a piston ring product is provided.

On the other hand, the martensitic steel poses the problem that, because it can be highly work-hardened, a high working rate cannot be attained in finishing with a flat wire or a shaped-section (or modified cross section) wire. This entails many cycles of annealing at a stage of drawing working or rolling working, thus resulting in increased cost.

SUMMARY OF THE INVENTION

The present invention seeks to provide a piston ring material which is highly capable of improving drawing workability or rolling workability for formation of wire materials during warm or cold working and also of giving rise to improved workability of shaped-section wire materials, coupled with least annealing cycle, utmost production economy and reduced material breakage during ring formation.

Through continued research made by the present inventors and leading to the invention, it has now been found that at least one of Si and Mn among various elements contained in an alloy, when restricted to a specific content, is noticeably effective in improving drawing workability or rolling workability of wire materials heat-treated for formation of piston rings as well as bending workability of these materials after heat treatment without any adverse effect had on various important qualities of the piston ring, such as anti-fatigue quality, toughness, wear resistance, anti-scuffing quality, nitriding acceptability and the like.

In a first aspect, the invention provides a piston ring material having excellent workability, which consists essentially of, by weight, 0.4 to 1.0% of C (carbon), 5.0 to 25.0% of Cr, at least one of not more than 0.25% Si and not more than 0.30% Mn, and balance of Fe and impurities.

In a second aspect, the invention provides a piston ring material having excellent workability, which consists essentially of, by weight, 0.4 to 1.0% of C, 5.0 to 25.0% of Cr, one or both of Mo and W in a content of not greater than 2.5% in terms of Mo+"W/2", at least one of not more than 0.25% Si and not more than 0.30% Mn, and balance of Fe and impurities.

In a third aspect, the invention provides a piston ring material having excellent workability, which consists essentially of, by weight, 0.4 to 1.0% of C, 5.0 to 25.0% of Cr, one or both of V and Nb in a content of not greater than 1.5% in terms of V+"Nb/2", at least one of not more than 0.25% Si and not more than 0.30% Mn, and balance of Fe and impurities.

In a fourth aspect, the invention provides a piston ring material having excellent workability, which consists essentially of, by weight, 0.4 to 1.0% of C, 5.0 to 25.0% of Cr, one or both of Mo and W in a content of not greater than 2.5% in terms of Mo+"W/2", one or both of V and Nb in a content of not greater than 1.5% in terms of V+"Nb/2", at least one of not more than 0.25% Si and not more than 0.30% Mn, and balance of Fe and impurities.

In the case where the respective above material is intended to have a hardness of not less than 48 HRC after quenching and tempering heat treatment while maintaining good workability, which is of second oil rings for example, its contents of carbon and Cr are prefrably 0.4 to 0.7% and 5.0 to 9.0%, respectively, and it has an elongation of not less than 9% in the tensile test determined when hardness after quenching and tempering is not less than 48 HRC.

DETAILED DESCRIPTION OF THE INVENTION

Figure 1:
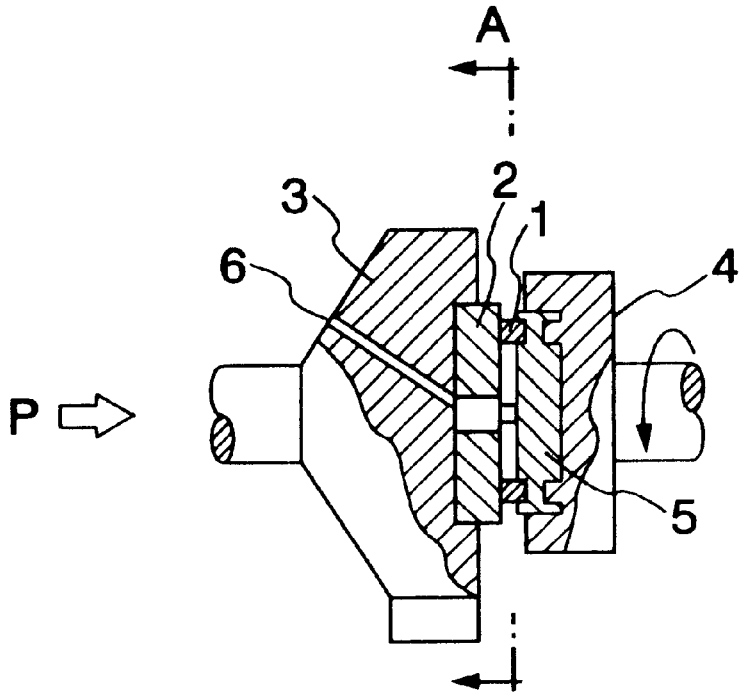
FIG. 1 is a cross-sectional view of superhigh-pressure frictional wear testing apparatus utilized for scuffing testing of the piston ring materials according to the present invention.

The following are the grounds of criticality in content of respective alloying element of the piston ring material excellent in workability. For purposes of simplicity, all amounts of alloying elements are based on weight percent unless otherwise noted.

C (carbon) is an essential element in the practice of the invention. This element is present as a solid solution in the corresponding matrix and has an important role to contribute to enhanced mechanical strength and fatigue resistance qualities. Moreover, it forms carbonizedes, leading to improved wear resistance and anti-scuffing property. In order to gain such physical improvements, the content of C should be not less than 0.4%, but not more than 1.0%. Excess C would impair drawing workability and rolling workability during warm or cold working as well as bending workability after heat treatment. Thus, C should be in a content of 0.4 to 1.0%. Carbon is preferred to be in a content of 0.6 to 1.0% for side rails and pressure rings among parts of a piston ring in which wear resistance is particularly required, and also in a content of 0.4 to 0.7% for second rings in which good workability is needed.

Si and Mn act to improve not only the workability of wire materials sought to be achieved by the invention, but also the formation of rings after hardening by heat treatment. Importantly, either one of Si and Mn should be restricted in its content to a specific range described later. Where oxides are needed to be formed in larger amounts in regard to some parts of the piston ring, particular restriction should preferably be imposed upon the contents of both Si and Mn.

Si is an essential deoxidizer element in steel smelting. For instance, JP-B2-2-4829 discloses that with a content of not less than 0.3%, Si leads to increased oxidation resistance and thermal yielding properties. Since, however, the piston ring is used in oil and/or subjected to surface treatment, the oxidation resistance property has not necessarily been considered most important. For attaining the thermal yielding property, other additive elements conducive to secondary hardening have been found to be more effective than Si because the piston ring before use is tempered at elevated temperature.

The present inventors have made a study of the relationship between the contents of Si in a steel as annealed and the cold workability of the steel. It has been found as a result of this study that Si when not more than 0.25% shows a sharp rise in the cold workability of the steel. This is evidenced also by the increased tensile test elongation and area reduction properties. It has also been confirmed that when the hardness is adjusted to 40 to 52 HRC by quenching (at 1,000 to 1,100° C.) and tempering (at 550 to 650° C.) heat treatment, not more than 0.25% Si improves not only tensile test elongation and area reduction, but also bending workability.

In addition to the above reasoning, recent advances in the steel making art allow Si even in smaller contents to lessen non-metallic inclusions. Thus, the content of Si should be not more than 0.25% and preferably in the range of 0.05 to 0.15%.

Mn is one of those elements which are necessary as deoxidizing and desulfurizing agents in steel refining. According to JP-B2-2-4829 stated above, Mn at least 0.5% is effective in improving strength and hardness. It has been found, however, that Mn exceeding 0.30% in content makes it difficult to decrease hardness at the time of tempering heat treatment, hence resulting in impaired plastic workability in tempered condition. Further in the case of more than 0.30% Mn, even if the material is adjusted to have a hardness of 40 to 52 HRC by quenching and tempering heat treatment, there was observed a drop in tensile test elongation and area reduction. Thus, the content of Mn should be not more than 0.30% and preferably in the range of 0.07 to 0.25%.

Si and Mn, alone or in combination, when restricted in their respective contents as specified above, are highly effective to attain improved workability of wire materials and increased bending workability after heat treatment. Also advantageously, the hardness property can be adjusted at rather high a level as bending workability is rendered easier. This means that the resultant piston ring when in use is capable of exhibiting its inherent wear resistance and anti-scuffing property to a greatest possible degree.

Cr is partially solutionized in the matrix to increase corrosion resistance as well as resistance to softening by tempering. A part of Cr combine with C to form carbides contributing to improved wear resistance and scuffing resistance properties. When the invention material is subjected to nitriding treatment, Cr combines with nitrogen to form hard nitrides so as to further improve wear resistance and also scuffing resistance. In such instance, the content of Cr should be at least 5%. Even if Si and Mn are maintained in their contents at a lower level, too much Cr adversely affects plastic workability after annealing, or a heat treatment to have a hardness of 40 to 52 HRC. Thus, the content of Cr should be not more than 25.0% and preferably in the range of 5.0 to 15.0%. To further improve workability or otherwise gain a hardness of 48 HRC after quenching and tempering heat treatment, Cr should preferably be set at from 5.0 to 9.0%.

Upon quenching at a hardness of 40 to 52 HRC, Mo and W are precipitated as fine carbides to improve wear resistance, anti-scuffing property and fatigue strength. Either one or both of Mo and W, therefore, can be added in an amount of not more than 2.5% in terms of Mo+"W/2". More than 2.5% in the equation would adversely affect the workability at the time of annealing and the bending workability at a hardness of 40 to 52 HRC adjusted by heat treatment. The Mo+"W/2" equation should be set to be not more than 2.5% and preferably not more than 1.5%.

V and Nb form hard carbonizedes and act to improve wear resistance. One or both of V and Nb should be not more than 1.5% in terms of V+"Nb/2". If the amount of V+"Nb/2" is more than 1.5%, primary carbides are produced to deteriorate workability as annealed and bending workability after quenching and tempering heat treatment. Thus, the contents of either one or both of V and Nb should be not more than 1.5% in terms of V+"Nb/2", preferably not more than 1.0%. In the case where the invention material is formed to a shaped-section wire having a not simple sectional figure such as a second oil ring and can have a hardness of not less than 48 HRC after quenching and tempering heat treatment to have good wear resistance, its contents of carbon and Cr are preferably limited to 0.4 to 0.7% and 5.0 to 9.0%, respectively, in order to restrain Cr-carbides to coarsen.

EXAMPLE 1

Through high-frequency induction dissolution in the atmosphere, ingots each of 30 kg were prepared which have chemical compositions shown in Table 1. Nos. 1 to 15 are invention specimens and Nos. 21 to 29 are specimens of comparative material. Comparing invention materials No. 1 to 9 with comparative materials No. 21 to 29 in order, respectively, each comparison pair materials have generally the same chemical composition except for the contents of Si and Mn. Each of the ingots was hot-worked to a wire material having a diameter of 8 mm. After annealing at 860° C. followed by slow cooling, one group of the wire materials were subjected to tensile testing for evaluation of workability. The other group of the wire materials as annealed were worked by drawing at room temperature into a wire diameter of 5.5 mm, followed by quenching from 1,050° C. Invention materials Nos. 1 to 3 and comparative materials Nos. 21 to 23 were adjusted in their tempering temperature to have a hardness of 48 to 50 HRC. Invention materials Nos. 4 to 15 and comparative materials Nos. 24 to 29 were adjusted in their tempering temperature to have a hardness of 39 to 42 HRC. Tensile testing was conducted as to the two material groups of different hardness.

Subjecting the wire materials to nitriding treatment which is usually applied to piston rings after heat treatment, the invention and comparative wire materials were subjected to the fatigue test and the anti-scuffing test. The tests were conducted with respect to specimens for the fatigue test and the anti-scuffing test taken from the wire materials after drawing in the conditions of the same heat treatment as that in the tensile test followed by gas-nitriding and subsequently at 640° C. for 20 removing brittle nitrides deposited on the surface of the specimens by means of polishing. The results are shown in Table 2 together with the surface hardnesses of the specimens after nitriding treatment.

TABLE 1

| | | Chemical Composition (wt. %) | | | | | | | | |
|---|---|---|---|---|---|---|---|---|---|---|
| Type | No. | C | Si | Mn | Cr | Mo | W | V | Nb | Fe |
| Invensive Material | 1 | 0.60 | 0.09 | 0.17 | 5.4 | 1.03 | — | — | — | Bal. |
| | 2 | 0.61 | 0.15 | 0.20 | 8.2 | — | — | — | — | " |
| | 3 | 0.59 | 0.13 | 0.21 | 8.1 | 1.00 | — | 0.20 | — | " |
| | 4 | 0.68 | 0.15 | 0.20 | 12.6 | — | — | — | — | " |
| | 5 | 0.65 | 0.14 | 0.21 | 12.4 | 0.71 | 0.51 | — | — | " |
| | 6 | 0.86 | 0.13 | 0.20 | 16.9 | 1.01 | — | 0.13 | — | " |
| | 7 | 0.85 | 0.14 | 0.12 | 16.8 | 1.04 | — | — | 0.10 | " |
| | 8 | 0.86 | 0.11 | 0.17 | 16.9 | — | 0.52 | 0.44 | 0.10 | " |
| | 9 | 0.93 | 0.12 | 0.20 | 20.8 | 1.12 | — | 0.11 | — | " |
| | 10 | 0.67 | 0.33 | 0.23 | 12.4 | — | — | 0.25 | — | " |
| | 11 | 0.84 | 0.20 | 0.35 | 16.8 | — | — | — | — | " |
| | 12 | 0.64 | 0.12 | 0.20 | 23.7 | — | — | — | — | " |
| | 13 | 0.83 | 0.13 | 0.21 | 16.7 | 2.23 | — | — | — | " |
| | 14 | 0.82 | 0.11 | 0.20 | 16.4 | — | — | 1.20 | — | " |
| | 15 | 0.85 | 0.11 | 0.24 | 16.6 | 0.22 | 0.15 | 0.09 | 0.03 | " |
| Comparative Material | 21 | 0.58 | 0.42 | 0.80 | 5.5 | 0.9 | — | — | — | " |
| | 22 | 0.60 | 0.32 | 0.86 | 8.1 | — | — | — | — | " |
| | 23 | 0.61 | 0.35 | 0.85 | 8.2 | 1.1 | — | 0.15 | — | " |
| | 24 | 0.67 | 0.31 | 0.76 | 12.5 | — | — | — | — | " |
| | 25 | 0.65 | 0.37 | 0.77 | 12.5 | 0.70 | 0.52 | — | — | " |
| | 26 | 0.85 | 0.32 | 0.74 | 16.9 | 1.1 | — | 0.12 | — | " |
| | 27 | 0.85 | 0.33 | 0.57 | 16.7 | 1.0 | — | — | 0.09 | " |
| | 28 | 0.85 | 0.37 | 0.71 | 16.9 | — | 0.50 | 0.41 | 0.09 | " |
| | 29 | 0.92 | 0.41 | 0.70 | 20.6 | 1.0 | — | 0.10 | — | " |

TABLE 2

| | | Properties of Annealed Material | | | | Properties of Heat-Treated Material | | | | After Nitriding Properties | | |
|---|---|---|---|---|---|---|---|---|---|---|---|---|
| Type | No. | Hardness (HRB) | Tensile strength ($N/mm^2$) | Elongation (%) | Area Reduction (%) | hardness (HRC) | Tensile strength ($N/mm^2$) | Elongation (%) | Area Reduction (%) | Surface Hardness (HV) | Fatigue Strength (*1) | Anti-Scuffing Property (*2) |
| Invensive Material | 1 | 83.9 | 572 | 37.7 | 71.0 | 49.0 | 1627 | 12.1 | 31.2 | 730 | 871 | 80 |
| | 2 | 84.1 | 580 | 37.5 | 71.2 | 48.7 | 1635 | 10.7 | 33.3 | 890 | 875 | 80 |
| | 3 | 85.5 | 607 | 35.7 | 70.0 | 49.3 | 1644 | 10.5 | 31.2 | 905 | 880 | 90 |

TABLE 2-continued

| | | Properties of Annealed Material | | | | Properties of Heat-Treated Material | | | | After Nitriding Properties | | |
|---|---|---|---|---|---|---|---|---|---|---|---|---|
| Type | No. | Hardness (HRB) | Tensile strength ($N/mm^2$) | Elongation (%) | Area Reduction (%) | hardness (HRC) | Tensile strength ($N/mm^2$) | Elongation (%) | Area Reduction (%) | Surface Hardness (HV) | Fatigue Strength (*1) | Anti-Scuffing Property (*2) |
| | 4 | 88.2 | 621 | 32.2 | 61.3 | 41.7 | 1320 | 13.1 | 24.3 | 1056 | 810 | 90 |
| | 5 | 93.8 | 745 | 28.3 | 44.7 | 40.1 | 1269 | 13.1 | 20.6 | 1050 | 805 | 90 |
| | 6 | 93.7 | 740 | 29.2 | 45.2 | 40.1 | 1275 | 8.0 | 12.7 | 1155 | 760 | 100 |
| | 7 | 94.1 | 751 | 29.2 | 45.6 | 40.7 | 1287 | 7.7 | 11.1 | 1140 | 775 | 100 |
| | 8 | 97.7 | 786 | 25.7 | 40.3 | 40.0 | 1275 | 6.4 | 10.7 | 1140 | 760 | 110 |
| | 9 | 99.5 | 827 | 22.1 | 34.0 | 39.7 | 1240 | 6.2 | 8.9 | 1170 | 720 | 120 |
| | 10 | 88.9 | 633 | 32.2 | 60.0 | 40.1 | 1241 | 13.0 | 22.9 | 1044 | 705 | 90 |
| | 11 | 92.4 | 726 | 29.7 | 43.5 | 41.0 | 1285 | 8.1 | 12.9 | 1120 | 720 | 100 |
| | 12 | 108.0 | 1006 | 19.6 | 37.3 | 39.2 | 1210 | 6.7 | 11.0 | 1145 | 710 | 110 |
| | 13 | 94.8 | 770 | 29.8 | 45.4 | 40.7 | 1280 | 7.9 | 12.7 | 1150 | 880 | 110 |
| | 14 | 97.5 | 744 | 26.6 | 43.0 | 40.1 | 1240 | 8.0 | 13.0 | 1145 | 880 | 100 |
| | 15 | 97.7 | 780 | 25.9 | 46.3 | 40.2 | 1209 | 7.8 | 12.7 | 1140 | 890 | 100 |
| Comparative Material | 21 | 84.1 | 587 | 36.7 | 68.7 | 48.9 | 1630 | 7.0 | 26.6 | 755 | 880 | 80 |
| | 22 | 85.6 | 613 | 35.3 | 68.2 | 48.7 | 1645 | 6.7 | 25.2 | 880 | 860 | 80 |
| | 23 | 87.1 | 620 | 33.6 | 65.6 | 49.5 | 1631 | 6.5 | 25.7 | 895 | 875 | 90 |
| | 24 | 89.9 | 647 | 30.1 | 56.1 | 41.6 | 1327 | 11.7 | 20.1 | 1051 | 800 | 90 |
| | 25 | 97.2 | 790 | 26.4 | 43.8 | 40.6 | 1287 | 11.2 | 18.7 | 1065 | 810 | 90 |
| | 26 | 98.2 | 798 | 25.5 | 41.2 | 40.0 | 1259 | 6.2 | 10.1 | 1140 | 770 | 100 |
| | 27 | 97.9 | 790 | 24.5 | 38.6 | 40.2 | 1272 | 6.5 | 8.7 | 1130 | 775 | 100 |
| | 28 | 100.2 | 822 | 23.1 | 37.6 | 40.1 | 1270 | 5.1 | 9.2 | 1155 | 750 | 110 |
| | 29 | 100.7 | 840 | 20.0 | 32.2 | 39.5 | 1227 | 5.1 | 7.5 | 1170 | 730 | 120 |
| | | Tensile Test (JIS 4) | | | | | | | | | | |

Note
*1: Rotary Bending Fatigue Strength ($N/mm^2$)
**2: Scuffed Surface Pressure ($Kg/cm^2$)

Figure 2:
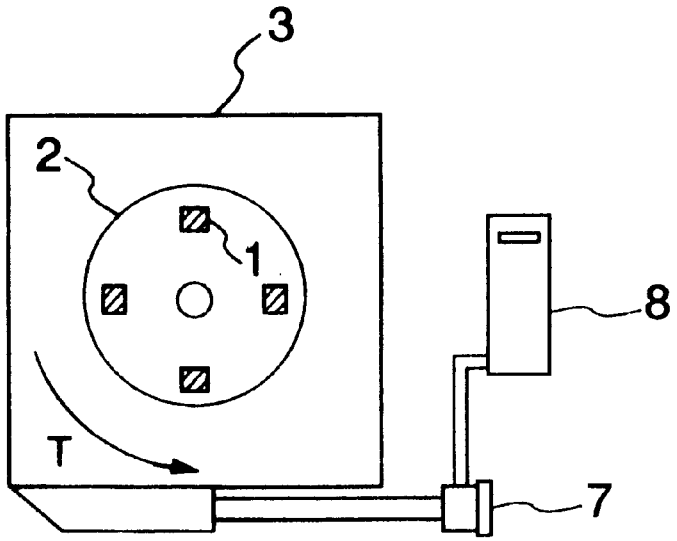
FIG. 2 is a cross-sectional view of the apparatus shown in FIG. 1 but taken along lines A—A.

Scuffing testing (burning testing) was effected by the use of ultrahigh-pressure frictional wear testing apparatus and under the conditions as follows. Details of the apparatus are shown in FIGS. 1 and 2.

Frictional sliding speed: 8 m/sec

Surface pressure at the sliding surface: Initial pressure 20 kgf /$cm^2$ with raising by 10 $kg/cm^2$ every 3 minutes Lubricating oil: Motor oil #30, temperature 80° C., supplied at 400 ml/min from stator holder at its center Seizure detection: A load cell and a dynamic strain meter (detecting abnormal frictional force due to occurrence of seizure)

Mating material: JIS gray cast iron, grade 4 (JIS FC25)

As to Table 2, comparing No. 1 to No. 21, No. 2 to No. 22, No. 3 to No. 23, No. 4 to No. 24, No. 5 to No. 25, No. 6 to No. 26, No. 7 to No. 27, No. 8 to No. 28, and No. 9 to 29, respectively, the materials of the invention as annealed reveal high reduction areas in the tensile test and good cold workability than the comparative materials. Comparing the invention materials and the comparative materials, the former materials have higher elongation in the tensile test after heat treatment. From this, we can ascertain the advantageous effect of the invention. The invention materials are favorably comparable in respect of fatigue property, nitriding acceptability and anti-scuffing property to the comparative materials. From this finding, it can be concluded that plastic workability after annealing, and bending workability after quenching treatment are improved by reducing contents of Si and Mn.

EXAMPLE 2

An effect of drawing working after annealing was studied with respect to the area reduction at the tensile test in Example 1. When the area reduction was above 65%, the reduction rate of cold drawing was over 90% without intermediate annealing. In the case of the area reduction below 40%, cracking took place on the material surface even at a reduction rate 50% of cold drawing. Namely, a wire material of less than 40% in the area reduction is required to have repetitive intermediate annealing treatments during drawing working, and this would involve complicated processes in running mass production. Further comparison was made of tensile test results after quenching and tempering heat treatment with the results derived from actual bending working. It was found that when the tensile test elongation exceeds 6%, bending working can be carried out with reliability and without breakage. Namely, where the tensile test elongation is not more than 6%, the hardness property needs to be adjusted to a slightly low level with a sacrifice to some physical properties desired for the piston ring itself.

As will be apparent from the above, according to the present invention piston ring material, one or two of Si and Mn are restricted to not more than 0.25% and not more than 0.30% in contents, respectively, thereby it is improved in drawing workability and rolling workability at cold or warm working after hot rolling resulting in cost saving. Bending workability after heat treatment can also be improved so that hardness at the time of heat treatment is adjusted to a higher level. Hence, physical properties required to the piston ring are considerably enhanced.

What is claimed is:

1. A piston ring formed of an alloy having excellent workability, which consists of, by weight, 0.4 to 1.0% of C, 5.0 to 25.0% of Cr, 0.05 to 0.25% of Si, 0.07 to 0.30% of Mn, and the balance of Fe and impurities.

2. A piston ring formed of an alloy according to claim 1, whose carbon and Cr contents are 0.4 to 0.7% and 5.0 to 9.0%, respectively, and which has not less than 9% of elongation in tensile test after quenching and tempering heat treatment.

3. A piston ring formed of an alloy having excellent workability, which consists of, by weight, 0.4 to 1.0% of C, 5.0 to 25.0% of Cr, one or both of Mo and W in a content of not greater than 2.5% in terms of Mo+"W/2", 0.05 to 0.25% of Si, 0.07 to 0.30% of Mn, and the balance of Fe and impurities.

4. A piston ring formed of an alloy according to claim 3, whose carbon and Cr contents are 0.4 to 0.7% and 5.0 to 9.0%, respectively, and which has not less than 9% of elongation in tensile test after quenching and tempering heat treatment.

5. A piston ring formed of an alloy having excellent workability, which consists of, by weight, 0.4 to 1.0% of C, 5.0 to 25.0% of Cr, one or both of V and Nb in a content of not greater than 1.5% in terms of V+"Nb/2", 0.05 to 0.25% of Si, 0.07 to 0.30% of Mn, and the balance of Fe and impurities.

6. A piston ring formed of an alloy according to claim 5, whose carbon and Cr contents are 0.4 to 0.7% and 5.0 to 9.0%, respectively, and which has not less than 9% of elongation in tensile test after quenching and tempering heat treatment.

7. A piston ring formed of an alloy having excellent workability, which consists of, by weight, 0.4 to 1.0% of C, 5.0 to 25.0% of Cr, one or both of Mo and W in a content of not greater than 2.5% in terms of Mo+"W/2", one or both of V and Nb in a content of not greater than 1.5% in terms of V+"Nb/2", 0.05 to 0.25% of Si, 0.07 to 0.30% of Mn, and the balance of Fe and impurities.

8. A piston ring formed of an alloy according to claim 7, whose carbon and Cr contents are 0.4 to 0.7% and 5.0 to 9.0%, respectively, and which has not less than 9% of elongation in tensile test after quenching and tempering heat treatment.

* * * * *